US010683875B2

(12) United States Patent
Shimizu

(10) Patent No.: US 10,683,875 B2
(45) Date of Patent: Jun. 16, 2020

(54) CENTER RING AND VACUUM PUMP

(71) Applicant: SHIMADZU CORPORATION, Kyoto (JP)

(72) Inventor: Koichi Shimizu, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 138 days.

(21) Appl. No.: 15/918,791

(22) Filed: Mar. 12, 2018

(65) Prior Publication Data

US 2018/0274556 A1 Sep. 27, 2018

(30) Foreign Application Priority Data

Mar. 21, 2017 (JP) ..... 2017-054701

(51) Int. Cl.

| | |
|---|---|
| ***F04D 29/64*** | (2006.01) |
| ***F04D 29/52*** | (2006.01) |
| ***F04D 29/058*** | (2006.01) |
| ***F04D 25/06*** | (2006.01) |
| ***F04D 29/08*** | (2006.01) |
| ***F04D 29/60*** | (2006.01) |
| ***F04D 29/70*** | (2006.01) |
| ***F04D 19/04*** | (2006.01) |

(52) U.S. Cl.

CPC ..... *F04D 29/644* (2013.01); *F04D 19/042* (2013.01); *F04D 25/06* (2013.01); *F04D 29/058* (2013.01); *F04D 29/083* (2013.01); *F04D 29/522* (2013.01); *F04D 29/601* (2013.01); *F04D 29/701* (2013.01)

(58) Field of Classification Search

None

See application file for complete search history.

(56) References Cited

U.S. PATENT DOCUMENTS 4,363,776 A * 12/1982 Yamada ..... H05H 1/12 376/124
4,838,978 A * 6/1989 Sekine ..... H01J 37/32431 118/50.1
2001/0039922 A1* 11/2001 Nakahara ..... C23C 16/4412 118/715

(Continued)

FOREIGN PATENT DOCUMENTS

| | | | |
|---|---|---|---|
| CN | 104983312 | A | 10/2015 |
| JP | 1999230087 | A | 8/1999 |
| JP | 2014-222044 | A | 11/2014 |

OTHER PUBLICATIONS

Office Action for corresponding Chinese Patent Application No. 201810184686.2, dated Jun. 19, 2019.

(Continued)

*Primary Examiner* — Michael Lebentritt

(74) *Attorney, Agent, or Firm* — Renner, Otto, Boisselle & Sklar, LLP

(57) ABSTRACT

A center ring interposed between a vacuum chamber and a vacuum pump, comprises: a ring main body including a first ring fitting portion to be fitted in a chamber-side fitting portion of the vacuum chamber and a second ring fitting portion to be fitted in a pump-side fitting portion of the vacuum pump; a foreign particle entrance prevention member provided at the ring main body; and a dropping prevention structure configured to prevent the center ring from dropping from the pump-side fitting portion of the vacuum pump.

8 Claims, 5 Drawing Sheets

(56) References Cited

U.S. PATENT DOCUMENTS

| | | | | |
|---|---|---|---|---|
| 2002/0172589 | A1* | 11/2002 | Yamashita | F04D 19/04 415/90 |
| 2003/0146085 | A1* | 8/2003 | Lawson | C23C 14/34 204/192.12 |
| 2005/0042881 | A1* | 2/2005 | Nishimoto | H01L 21/67248 438/710 |
| 2013/0170955 | A1* | 7/2013 | Sakaguchi | F04D 19/042 415/116 |
| 2014/0262766 | A1* | 9/2014 | Yasumatsu | H01J 37/32651 204/298.11 |
| 2015/0063993 | A1* | 3/2015 | Tsutsui | F01D 5/288 415/200 |
| 2017/0025254 | A1* | 1/2017 | Tandou | H01J 37/32009 |
| 2017/0278730 | A1* | 9/2017 | Tandou | H01L 21/67248 |
| 2018/0211893 | A1* | 7/2018 | Ichino | H01L 22/30 |
| 2018/0340521 | A1* | 11/2018 | Takeda | F04B 39/08 |

OTHER PUBLICATIONS

"Electrical Module" of the "Ultra-supercritical Thermal Power Unit Training Series". The 14th chapter of the entire book.

* cited by examiner

B-B

C-C

CENTER RING AND VACUUM PUMP

TECHNICAL FIELD

The present invention relates to a center ring and a vacuum pump.

BACKGROUND ART

A turbo-molecular pump used for high-vacuum pumping of a vacuum device such as a semiconductor manufacturing device or a liquid crystal panel manufacturing device includes a plurality of rotor blades and a plurality of stator blades, the rotor blades and the stator blades being alternately arranged. A rotor provided with the rotor blades is, at high speed, rotated relative to the stator blades, and in this manner, gas is exhausted.

When the turbo-molecular pump is attached to, e.g., a vacuum chamber of the semiconductor manufacturing device, a center ring as a seal component might be arranged between a vacuum-chamber-side flange and a suction flange of the turbo-molecular pump (see Patent Literature 1 (JP-A-2014-222044)).

In the case of attaching the turbo-molecular pump to the vacuum chamber, the suction flange and the vacuum-chamber-side flange are joined together after the center ring has been attached to the suction flange of the turbo-molecular pump. The vacuum pump includes the type of attaching the vacuum pump to the vacuum chamber in a portrait orientation, and the type of attaching the vacuum pump to the vacuum chamber in a landscape orientation. In the case of employing the type of attachment in the landscape orientation, the center ring is attached to the suction flange in advance, and then, the vacuum pump is attached to the vacuum chamber with the vacuum pump being tilted. Thus, there is a probability that the center ring is dropped from the suction flange.

SUMMARY OF THE INVENTION

A center ring interposed between a vacuum chamber and a vacuum pump, comprises: a ring main body including a first ring fitting portion to be fitted in a chamber-side fitting portion of the vacuum chamber and a second ring fitting portion to be fitted in a pump-side fitting portion of the vacuum pump; a foreign particle entrance prevention member provided at the ring main body; and a dropping prevention structure configured to prevent the center ring from dropping from the pump-side fitting portion of the vacuum pump.

The ring main body is a single annular member or a pair of annular members cut at one or two cut portions on a circumference.

In the dropping prevention structure, end surfaces of the ring main bodies are arranged with a clearance in each cut portion, and the ring main body has a circumferential length shortened by a length corresponding to the clearance.

The ring main body includes a cutout portion configured to adjust rigidity upon bending in an inward radial direction.

The dropping prevention structure is provided only at the second ring fitting portion.

The dropping prevention structure is a structure in which a dimension difference between a diameter of the pump-side fitting portion of the vacuum pump and a diameter of the second ring fitting portion is set for any of interference fit or transition fit.

A vacuum pump comprises: the center ring according to claim 1; and a pump main body including a suction flange as the pump-side fitting portion to be attached to the center ring.

According to the present invention, the center ring is not dropped from the vacuum pump.

DETAILED DESCRIPTION OF THE EXEMPLARY EMBODIMENTS

Figure 1:
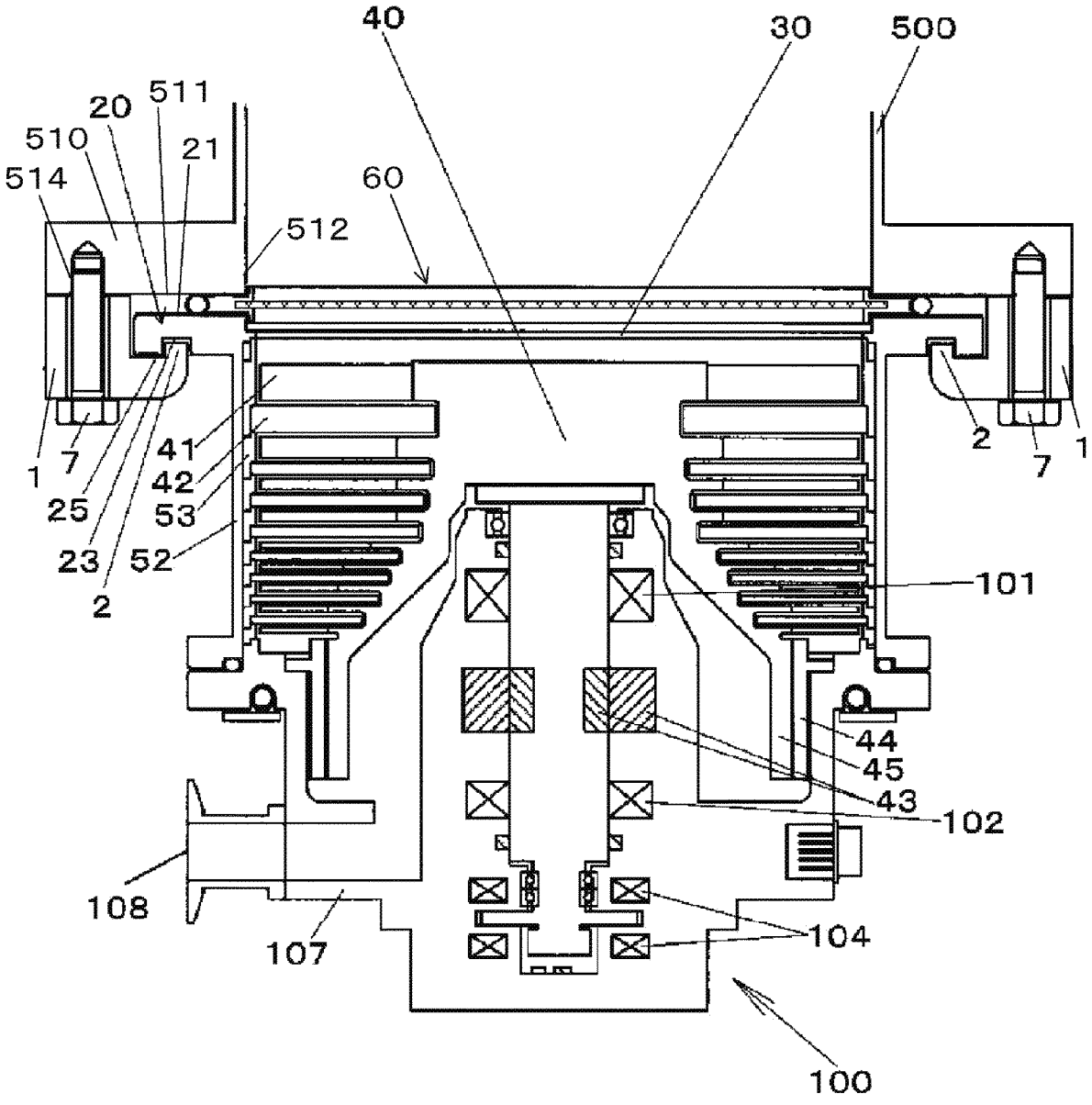
FIG. 1 is a schematic sectional view of an internal configuration of a vacuum pump of an embodiment.
Figure 2:
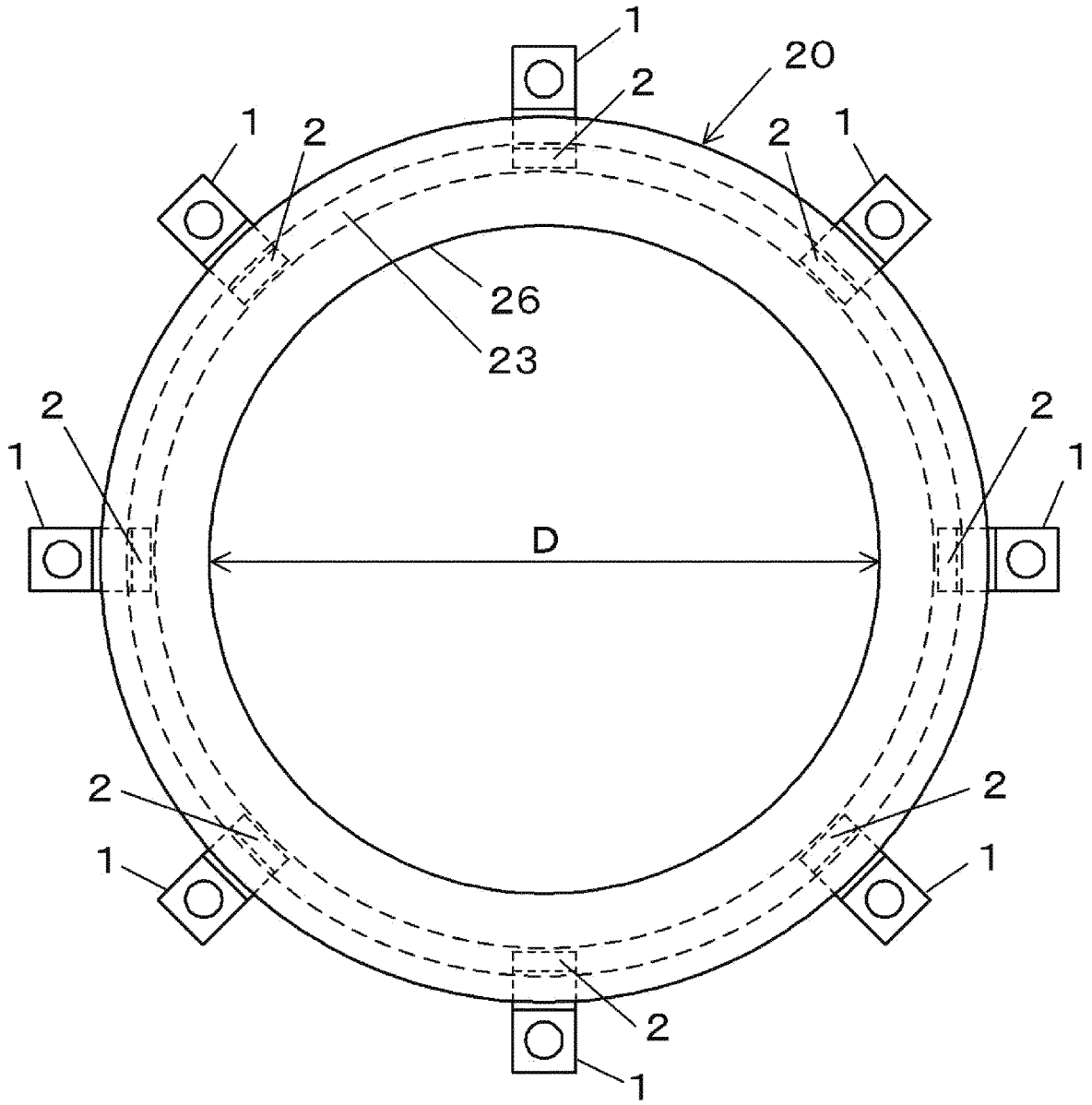
FIG. 2 is a view of arrangement of clamps 1 from a side close to a vacuum chamber 500 illustrated in FIG. 1.

One embodiment of a center ring and a vacuum pump including the center ring will be described with reference to FIGS. 1 to 4A and 4B. FIG. 1 is, as one example of the vacuum pump, a sectional view of a schematic configuration of a turbo-molecular pump 100 attached to a vacuum chamber 500. FIG. 2 is a view of arrangement of clamps 1 from a side close to the vacuum chamber 500 of FIG. 1. Note that in FIG. 2, bolts 7 for fixing the clamps 1 to an exhaust flange 510, the vacuum chamber 500, etc. are not shown. The number of clamps 1 to be used for fixing a suction flange 20 is determined according to a flange diameter.

The suction flange 20 of the turbo-molecular pump 100 illustrated in FIG. 1 is a so-called clamp-fixed flange. Using the plurality of clamps 1, the suction flange 20 is fastened to the exhaust flange 510 of the vacuum chamber 500, and therefore, the vacuum pump is fixed to the vacuum chamber 500. Each clamp 1 used in the present embodiment is a so-called single claw clamp.

A rotor 40 is rotatably provided in a case 52 of the turbo-molecular pump 100. The turbo-molecular pump 100 illustrated in FIG. 1 is a magnetic bearing pump, and the rotor 40 is non-contact supported by upper radial electromagnets 101, lower radial electromagnets 102, and thrust electromagnets 104. The rotor 40 magnetically levitated by the magnetic bearings is rotatably driven at high speed by a motor 43.

The rotor 40 is provided with a plurality of rotor blades 41 and a cylindrical screw rotor 45. A stator blade 42 is provided between adjacent ones of the rotor blades 41 in an axial direction, and a screw stator 44 is provided on an outer peripheral side of the screw rotor 45. Each stator blade 42 is placed on a base 107 through a corresponding one of spacers 53. When the case 52 provided with the suction flange 20 is fixed to the base 107, the stack of the spacers 53 is sandwiched between the base 107 and the case 52, and the positions of the stator blades 42 are determined and fixed.

The base 107 is provided with an exhaust port 108, and a back pump is connected to the exhaust port 108. The rotor 40 is magnetically levitated while being rotatably driven at high speed by the motor 43. In this manner, gas molecules are exhausted from a suction port 30 to the exhaust port 108.

A center ring 60 is sandwiched between a sealing surface 511 of the exhaust flange 510 of the vacuum chamber 500 and a sealing surface 21 of the suction flange 20 of the turbo-molecular pump 100. An annular groove 23 is formed at a back surface 25 of the suction flange 20 opposite to the sealing surface 21. The exhaust flange 510 is provided with a plurality of screw holes 514.

As illustrated in FIG. 1, claw portions 2 of the clamps 1 are inserted into the annular groove 23 formed at the back surface 25 of the suction flange 20 of the turbo-molecular pump 100. When the clamps 1 are further fixed to the exhaust flange 510 of the vacuum chamber 500 by means of the bolts 7, the suction flange 20 of the turbo-molecular pump 100 and the exhaust flange 510 are fastened together. As described above, the clamps 1 are used to attach the turbo-molecular pump 100 to the exhaust flange 510 of the vacuum chamber 500.

Note that bolt through-holes may be, instead of the screw holes 514, formed at the exhaust flange 510 of the vacuum chamber 500, and the bolts 7 and nuts may be used to fasten the suction flange 20 and the exhaust flange 510 together.

Center Ring 60

Figure 3A:
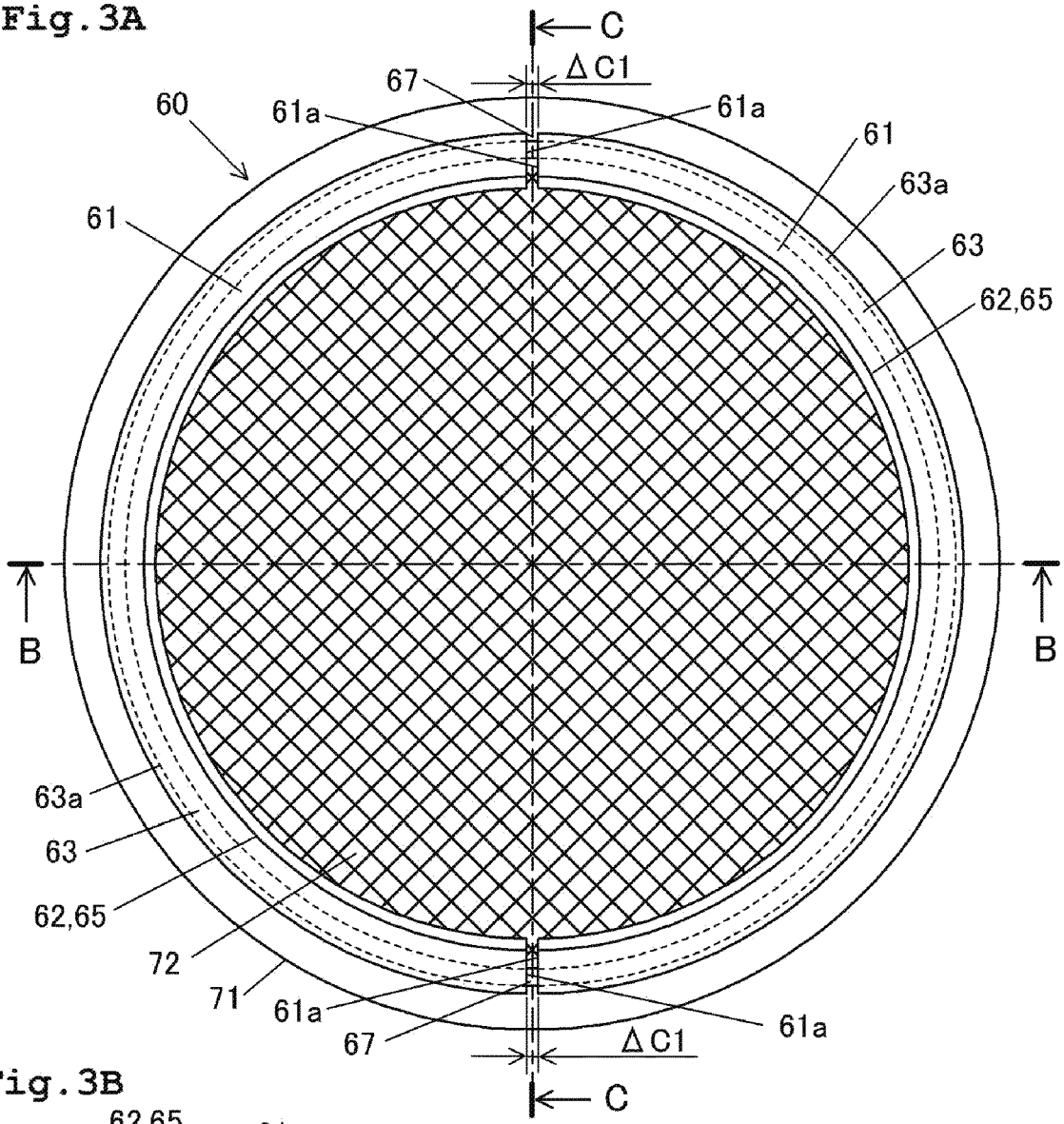
FIG. 3A is an upper view of a center ring 60 from a side close to an attachment surface for an exhaust flange 510.
Figure 3B:
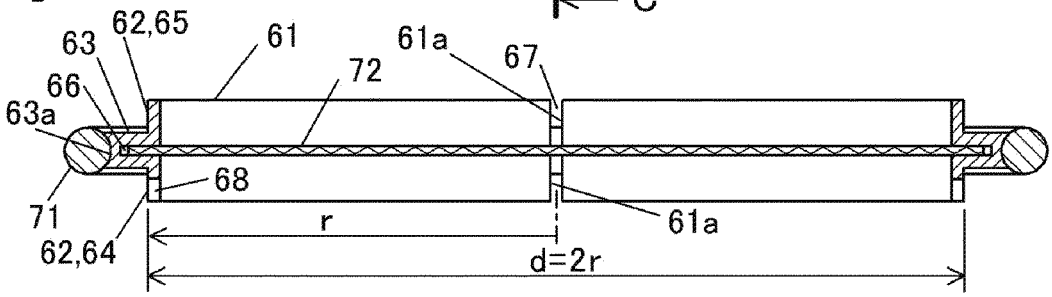
FIG. 3B is a sectional view along a B-B line of FIG. 3A.
Figure 3C:
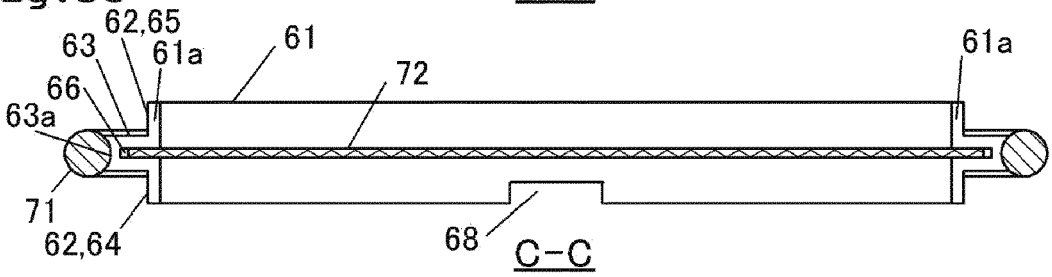
FIG. 3C is a sectional view along a C-C line of FIG. 3A.

FIG. 3A is an upper view of the center ring 60 from aside close to an attachment surface for the exhaust flange 510, FIG. 3B is a sectional view along a B-B line of FIG. 3A, and FIG. 3C is a sectional view along a C-C line of FIG. 3A. The center ring 60 has a pair of ring main bodies 61, an O-ring 71 configured to seal between the sealing surface 511 of the exhaust flange 510 of the vacuum chamber 500 and the sealing surface 21 of the suction flange 20 of the turbo-molecular pump 100, and a net 72 for preventing a foreign material from entering the turbo-molecular pump 100.

The ring main bodies 61 are members forming such a ring shape that a cylinder is divided into two portions along the axial direction, and are made of metal such as aluminum or stainless steel. Each ring main body 61 has a cylindrical portion 62 having a semicylindrical shape, and a flange portion 63 protruding outward in a radial direction from an outer peripheral surface of the cylindrical portion 62. A portion of the cylindrical portion 62 below the flange portion 63 as viewed in the figure will be referred to as a "pump-side cylindrical portion 64," and a portion of the cylindrical portion 62 above the flange portion 63 as viewed in the figure will be referred to as a "chamber-side cylindrical portion 65." A recessed groove 63*a* for attachment of the O-ring 71 is formed at outer peripheral surfaces of the flange portions 63. A groove 66 for sandwiching of the net 72 is provided at inner peripheral surfaces of the cylindrical portions 62. At each pump-side cylindrical portion 64, a cutout portion 68 is provided in the vicinity of the middle of the circumferential length of the pump-side cylindrical portion 64. As will be described later, each cutout portion 68 is provided for adjusting, e.g., relieving, flexural rigidity of the ring main body 61 in the radial direction.

The ring main bodies 61 sandwich an outer peripheral edge of the net 72 at the grooves 66 of the cylindrical portions 62 of the ring main bodies 61. The O-ring 71 is attached to the grooves 63*a* of the flange portions 63 of the ring main bodies 61. In other words, the O-ring 71 is wound around the grooves 63*a* of the flange portions 63 of the ring main bodies 61.

This center ring 60 is assembled as follows. The outer peripheral edge of the circular plate-shaped net 72 is inserted into the grooves 66 of the cylindrical portions 62 of the ring main bodies 61, and in this manner, these three members are integrated together. The O-ring 71 is attached to the grooves 63*a* formed at outer peripheral surfaces of the integrated ring main bodies 61. The members integrated by attachment of the O-ring 71 form the center ring 60.

By elastic force of the O-ring 71, the ring main bodies 61 are biased in a direction in which the ring main bodies 61 approach each other. By such biasing force, the ring main bodies 61 slide the outer peripheral edge of the net 72 in an inward radial direction. Note that as will be described later, a difference between the outer diameter d of the ring main bodies 61 and the inner diameter D of the suction flange 20 after movement is set for desired fitting, and a distance ΔC1 between end surfaces of the ring main bodies 61 is a desired value.

In this center ring 60, the end surface 61*a* of one of the ring main bodies 61 in a circumferential direction and the end surface 61*a* of the other ring main body 61 in the circumferential direction are arranged facing each other with the distance ΔC1. The clearance distance ΔC1 will be described later. Note that a region where the end surfaces 61*a* face each other will be specifically referred to as a "cut portion 67" of the center ring 60.

When the turbo-molecular pump 100 is attached to the exhaust flange 510 of the vacuum chamber 500, the center ring 60 is attached to the suction flange 20 of the turbo-molecular pump 100 in advance. That is, the pump-side cylindrical portions 64 of the ring main bodies 61 are inserted into an inner peripheral surface 26 of the suction flange 20. The pump-side cylindrical portions 64 form a fitting portion to be fitted in the inner peripheral surface 26 of the suction flange 20.

When the turbo-molecular pump 100 is attached to the vacuum chamber 500 with the center ring 60 being attached to the suction flange 20, i.e., when the suction flange 20 and the exhaust flange 510 are fastened together as described above, the chamber-side cylindrical portions 65 of the center ring 60 are inserted into an inner peripheral surface 512 of the exhaust flange 510. The chamber-side cylindrical portions 65 form a fitting portion to be fitted in the inner peripheral surface 512 of the exhaust flange 510.

When an upper-to-lower direction of FIG. 1 is the vertical direction, the turbo-molecular pump 100 is attached to the vacuum chamber 500 in a portrait orientation. When a right-to-left direction of FIG. 1 is the vertical direction, the turbo-molecular pump 100 is attached to the vacuum chamber 500 in a landscape orientation. The portrait orientation is an attachment form in which a rotor shaft of the turbo-molecular pump 100 extends in the vertical direction, and the landscape orientation is an attachment form in which the rotor shaft of the turbo-molecular pump 100 extends in the horizontal direction.

The vacuum pump of this embodiment improves assembling properties upon attachment in the landscape orientation, for example. Description will be made below.

The center ring 60 is sometimes dropped from the suction flange 20 at the step of attachment in the landscape orientation. Thus, the inventor(s) et al. have sought the cause of such dropping, and have found as follows.

Attachment in the landscape orientation is an attachment method employed in a case where the sealing surface 511 of the exhaust flange 510 faces the horizontal direction. Upon attachment in the landscape orientation, the center ring 60 is attached to the suction flange 20 with the rotor shaft of the turbo-molecular pump 100 being along the vertical direction, for example. Thereafter, after the posture of the turbo-molecular pump 100 has been tilted such that the sealing surface 21 of the suction flange 20 faces the horizontal direction, the positions of the exhaust flange 510 and the suction flange 20 are adjusted to each other, and the suction flange 20 is attached to the exhaust flange 510. When the posture of the turbo-molecular pump 100 is tilted at such an attachment step, the center ring 60 might be dropped from the suction flange 20.

For this reason, in the turbo-molecular pump 100 of the present embodiment, at least the outer diameter (the diameter) d of the pair of pump-side cylindrical portions 64 as components of the center ring 60 is set to prevent the center ring 60 from dropping from the suction flange 20 even when the posture of the turbo-molecular pump 100 is tilted. Detailed description will be also made below with reference to FIGS. 4A and 4B.

Figure 4A:
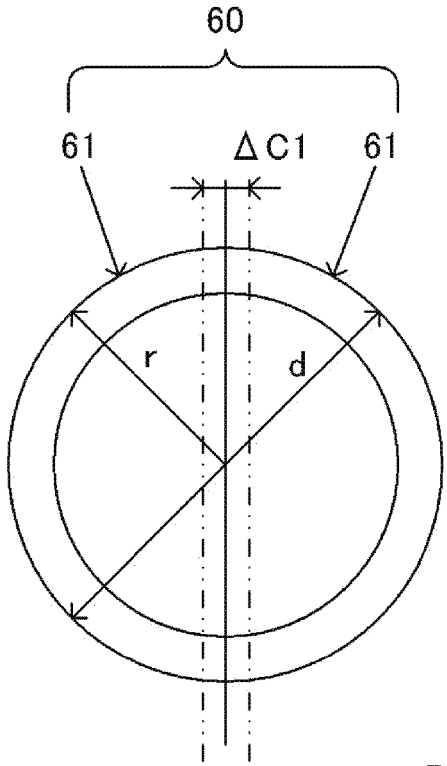
FIGS. 4A and 4B are schematic views for describing the outer diameter dimensions and the inner diameter dimensions of the center ring and a suction flange inner peripheral surface, FIG. 4A being a plan view and FIG. 4B being a sectional view.
Figure 4B:
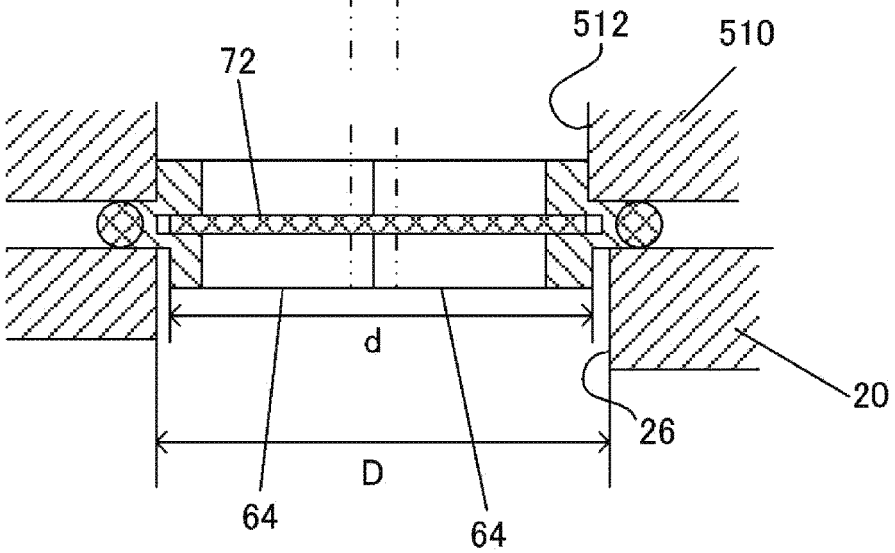

As illustrated in FIGS. 3B and 4A, the curvature radius of the outer peripheral surface of the single pump-side cylindrical portion 64 is r, and the double value of the curvature radius r is the diameter d of a circular ring outer peripheral surface when the pair of pump-side cylindrical portions 64 forms a circular ring. Note that in description below, the curvature radius r of the outer peripheral surface of the single pump-side cylindrical portion 64 will be also simply referred to as the "curvature radius r of the pump-side cylindrical portion 64," and the diameter d of the outer peripheral surface of the circular ring formed by the pair of pump-side cylindrical portions 64 will be also simply referred to as the "outer diameter d of the pair of pump-side cylindrical portions 64."

Moreover, as illustrated in FIG. 2, the diameter of the inner peripheral surface 26 of the suction flange 20 is D. In description below, the diameter D of the inner peripheral surface 26 of the suction flange 20 will be also simply referred to as the "inner diameter D of the suction flange 20."

Outer Diameter d of Pump-Side Cylindrical Portions 64 and Clearance Distance ΔC1

In the present embodiment, the dimension difference between the inner diameter D of the suction flange 20 and the outer diameter d of the circular ring of the pair of pump-side cylindrical portions 64 is optimized such that the center ring 60 is not dropped from the suction flange 20 due to the weight of the center ring 60 itself even when the suction flange 20 is tilted upon placement of the turbo-molecular pump 100 in the landscape orientation and that attachment/detachment to/from the suction flange 20 is facilitated, for example. That is, in the present embodiment, the outer diameter d of the pair of pump-side cylindrical portions 64 is set such that the dimension difference D−d between such an outer diameter d and the inner diameter D of the suction flange 20 falls within a predetermined range.

As described with reference to FIGS. 3A to 3C, the ring main bodies 61 forming the center ring 60 of the embodiment can be apart from each other by the distance ΔC1 in the cut portion 67 in which the end surfaces 61*a* in the circumferential direction face each other. Thus, the circumferential length of the ring main body 61 with the radius r is r×π−ΔC1. Each of the ring main bodies 61 is movable in the inward radial direction by ΔC1/2. Thus, as illustrated in FIG. 3B, the outer diameter of the net 72 and a groove depth are set such that a clearance between a bottom surface of the groove 66 of the ring main body 61 and an outer peripheral surface of the net 72 is Radius r−ΔC1/2.

As described later, in a case where the dimension difference D−d between the inner diameter D of the suction flange 20 and the outer diameter d of the pair of pump-side cylindrical portions 64 is a negative value (interference fit), even when the ring main bodies 61 approach each other by ΔC1, the outer diameter d of the pump-side cylindrical portions 64 is larger than the inner diameter D of the inner peripheral surface of the suction flange 20 in the direction perpendicular to such an approaching direction, and therefore, insertion cannot be made. Thus, the end portions of the ring main bodies 61 in the circumferential direction need to be bent in the direction perpendicular to the approaching direction.

Thus, ΔC1 needs to be determined such that (Absolute Value of D−d)+(Radial Deformation Amount of End Portions of Pump-Side Cylindrical Portion 64 upon Deformation in Approaching Direction Due to Bending) is satisfied. Detailed expressions for calculating ΔC1 will be described later.

As described above, upon attachment to the suction flange 20, both end portions of the ring main bodies 61 are bent inward in the radial direction. In this state, the outer diameter d of the pump-side cylindrical portions 64 decreases while the opposing end surfaces 61*a* approach each other in each cut portion 67. If the ring main bodies 61 are further bent inward in the radial direction after the opposing end surfaces 61*a* have contacted each other in each cut portion 67, the pair of ring main bodies 61 is deformed in such an oval shape that an upper-to-lower size in FIG. 3A decreases while a right-to-left size in FIG. 3A increases. For this reason, there is a probability that the pump-side cylindrical portions 64 of the ring main bodies 61 cannot be inserted into the inner peripheral surface 26 of the suction flange 20.

Thus, the clearance distance ΔC1 needs to be ensured such that the opposing end surfaces 61*a* do not contact each other in each cut portion 67 until both end portions of the ring main bodies 61 are bent by the maximum possible interference value (the interference fit dimension).

In other words, when the amount of inward bending of both end portions of the ring main bodies 61 in the radial direction is less than the maximum possible interference value, the circumferential length of each pump-side cylindrical portion 64 may be set such that the opposing end surfaces 61*a* do not contact each other in each cut portion 67. When ΔC1 is set with reference to the maximum value of the interference, the end surfaces 61*a* may contact each other.

Specifically, the total 2 L of the circumferential lengths L of the pump-side cylindrical portions 64 of the ring main bodies 61 may be, as shown in Expression (1) described below, equal to or less than a circumferential length corresponding to a diameter (d−Smax) smaller than the outer diameter d of the pump-side cylindrical portions 64 by the maximum value Smax of the interference.

$$2L \leq \pi \times (d - S\max) \quad (1)$$

A difference πd−2 L between the total 2 L of the circumferential lengths L of the pump-side cylindrical portions 64 of the ring main bodies 61 and the circumferential length rid corresponding to the diameter d as described above is the total (2×ΔC1) of the clearance distances ΔC1 of the two cut portions 67.

Thus, Expression (2) described below is satisfied:

$$2 \times \Delta C1 = \pi d - 2L$$

$$2L = \pi d - 2 \times \Delta C1 \quad (2)$$

When obtained from Expressions (1) and (2), the clearance distance ΔC1 is represented by Expression (3) described below:

$$\pi d-2\times\Delta C1\leq\pi\times(d-S\max)$$

$$-2\times\Delta C1\leq-\pi\times S\max$$

$$\pi\times S\max\leq 2\times\Delta C1$$

$$0.5\times\pi\times S\max\leq\Delta C1 \quad (3)$$

A specific example will be described below.

In the present embodiment, the suction flange 20 is, e.g., an ISO flange with a nominal diameter of 100 [mm], and the inner diameter D is 102 [mm]. In this case, the outer diameter d of the pair of pump-side cylindrical portions 64 is, as shown in Expression (4) described below, set such that the dimension difference D−d between the inner diameter D of the suction flange 20 and the outer diameter d of the pair of pump-side cylindrical portions 64 falls within a range of 0.05 [mm] to −0.1 [mm].

$$-0.1\ [\mathrm{mm}]\leq D-d\leq 0.05\ [\mathrm{mm}] \quad (4)$$

Note that when the value of the dimension difference D−d is a positive value, the dimension difference D−d indicates the size of a clearance between the inner peripheral surface 26 of the suction flange 20 and the outer peripheral surface of the pair of pump-side cylindrical portions 64. When the value of the dimension difference D−d is a negative value, i.e., when the outer diameter d of the pair of pump-side cylindrical portions 64 is larger than the inner diameter D of the suction flange 20, the absolute value of the dimension difference D−d is the interference between the inner peripheral surface 26 of the suction flange 20 and the outer peripheral surface of each pump-side cylindrical portion 64.

When the outer diameter d of the pair of pump-side cylindrical portions 64 is larger than the inner diameter D of the suction flange 20, both end portions of the ring main bodies 61 are moved inward in the radial direction by equal to or longer than a distance represented by (D−d)/2. Further, the end portions of the ring main bodies 61 are bent in the direction perpendicular to the moving direction while the pump-side cylindrical portions 64 are inserted into the suction flange 20.

As described above, the ring main bodies 61 of the present embodiment is provided with the distance ΔC1 between the end surfaces, and approach each other such that both end portions thereof are bent in the inward radial direction. Since the pump-side cylindrical portions 64 are provided with the cutout portions 68, the ring main bodies 61 are easily bendable in the radial direction. With this configuration, the center ring 60 can be easily attached/detached to/from the suction flange 20. As a result, efficiency in the process of attaching the turbo-molecular pump 100 to the exhaust flange 510 and the process of detaching the turbo-molecular pump 100 from the exhaust flange 510 is improved.

By bending of the pump-side cylindrical portions 64 upon attachment to the suction flange 20, the pair of pump-side cylindrical portions 64 presses the inner peripheral surface of the suction flange 20. Reactive force of such pressing contributes to prevention of dropping of the center ring 60.

Note that when the turbo-molecular pump 100 is attached to the exhaust flange 510, the chamber-side cylindrical portions 65 of the ring main bodies 61 are inserted into the inner peripheral surface 512 of the exhaust flange 510 with the center ring 60 being attached to the suction flange 20. Thus, for easily inserting the chamber-side cylindrical portions 65 of the ring main bodies 61 into the inner peripheral surface 512 of the exhaust flange 510, the outer diameter of the chamber-side cylindrical portions 65 is set such that a clearance is, as necessary, formed between the inner peripheral surface 512 of the exhaust flange 510 and each chamber-side cylindrical portion 65 of the ring main bodies 61. Thus, the clearance between the inner peripheral surface 512 of the exhaust flange 510 and each chamber-side cylindrical portion 65 of the ring main bodies 61 is preferably larger than the dimension difference D−d between the inner diameter D of the suction flange 20 and the outer diameter d of the pump-side cylindrical portions 64. Fitting of the center ring 60 on a vacuum chamber side in the embodiment is clearance fit.

As described above, in the present embodiment, the suction flange 20 is, e.g., the ISO flange with a nominal diameter of 100 [mm], and the maximum value Smax of the interference is 0.1 [mm] as shown in Expression (4). Thus, in the present embodiment, the clearance distance ΔC1 is set to equal to or longer than $\pi\times S\max/2=0.05\times\pi$ [mm].

In the turbo-molecular pump 100 of the present embodiment, the maximum clearance is 0.05 mm in a case where the inner diameter D of the suction flange 20 is larger than the outer diameter d of the pair of pump-side cylindrical portions 64. As a result of study by the inventor(s) et al., dropping of the center ring due to tilting of the turbo-molecular pump in the landscape orientation can be prevented even in the case of clearance fit with a maximum clearance of 0.05 mm.

According to the present embodiment, the following features and advantageous effects are provided.

(1) The center ring of the embodiment, i.e., the center ring 60 interposed between the vacuum chamber 500 and the turbo-molecular pump 100, includes: the ring main bodies 61 having the chamber-side cylindrical portions 65 as a first ring fitting portion to be fitted in the exhaust flange 510 as a chamber-side fitting portion of the vacuum chamber 500 and the pump-side cylindrical portions 64 as a second ring fitting portion to be fitted in the suction flange 20 as a pump-side fitting portion of the turbo-molecular pump 100; the net 72 as a foreign particle entrance prevention member provided at the ring main bodies 61; and a dropping prevention structure configured to prevent the center ring 60 from dropping from the suction flange 20 in the process of tilting the rotor shaft of the turbo-molecular pump 100 from the vertical direction to the horizontal direction, for example.

The turbo-molecular pump of the embodiment includes the dropping prevention structure, and therefore, dropping of the center ring 60 from the suction flange 20 due to the weight of the center ring 60 itself is prevented even when the suction flange 20 is tilted. Moreover, as in the embodiment, the dimension of the distance ΔC1 between the end surfaces 61*a* of the ring main bodies 61 and the fitting dimension between the center ring 60 and the inner peripheral surface 26 of the suction flange 20 are defined, and therefore, the center ring 60 is easily attached/detached to/from the suction flange 20. Thus, the efficiency in the process of attaching the turbo-molecular pump 100 to the exhaust flange 510 of the vacuum chamber 500 and the process of detaching the turbo-molecular pump 100 from the exhaust flange 510 is improved.

(2) The ring main bodies 61 of the embodiment has the dual-partitioned structure cut at the two cut portions 67 on the circumference. The number of components of the dropping prevention structure is two, and the number of components is greater than that of a typical case. However, only the shape and the fitting dimension may be defined, and therefore, this does not lead to a significant cost increase.

(3) In the pair of ring main bodies 61 with the dual-partitioned structure, the end surfaces 61*a* are arranged with the clearance ΔC1 in each cut portion 67. The circumferential length of the ring main body 61 is shortened by the length corresponding to the above-described clearance ΔC1. When both end portions of the ring main bodies 61 are bent in the inward radial direction by a desired amount, the end surfaces do not contact each other, and therefore, the center ring 60 can be smoothly attached to the suction flange 20.

(4) The ring main bodies 61 of the embodiment include the cutout portions 68 configured to adjust the rigidity upon bending in the inward radial direction. With the cutout portions 68, both end portions of the ring main bodies 61 are easily bendable in the inward radial direction.

(5) The dropping prevention structure of the embodiment is provided only at the pump-side cylindrical portions 64 as the second ring fitting portion. The dimension tolerance of the exhaust flange 510 of the vacuum chamber cannot be grasped by a turbo-molecular pump manufacturer. Thus, unlike the pump-side fitting portion, clearance fit is preferably made with such values that attachment is reliably facilitated.

(6) The dropping prevention structure of the embodiment is the structure in which the dimension difference D−d between the diameter D of the suction flange inner peripheral surface 26 of the turbo-molecular pump 100 and the diameter d of the pump-side cylindrical portions 64 is set for any of interference fit or transition fit.

(7) The turbo-molecular pump includes the center ring 60 of the embodiment, and a pump main body (e.g., a case) having the suction flange 20 as the pump-side fitting portion to be attached to the center ring 60.

The above-described embodiment has been set forth merely as one example, and the present invention is not limited to the ISO flange. In the example where the ISO flange is used, the present invention is not limited to the nominal diameter and fitting as described above.

The following variations also fall within the scope of the present invention, and one or more of the variations may be combined with the above-described embodiment.

(First Variation)

In the above-described embodiment, the center ring 60 has the pair of ring main bodies 61 cut at the two cut portions 67. On the other hand, a center ring 60A of a first variation has a C-shaped ring main body 61A cut at a single cut portion 67.

Detailed description will be made below with reference to FIGS. 5A and 5B. Note that in description below, the same reference numerals as those of the above-described embodiment are used to represent equivalent elements, and differences will be mainly described. Points which will not be specifically described are the same as those of the above-described embodiment.

Figure 5A:
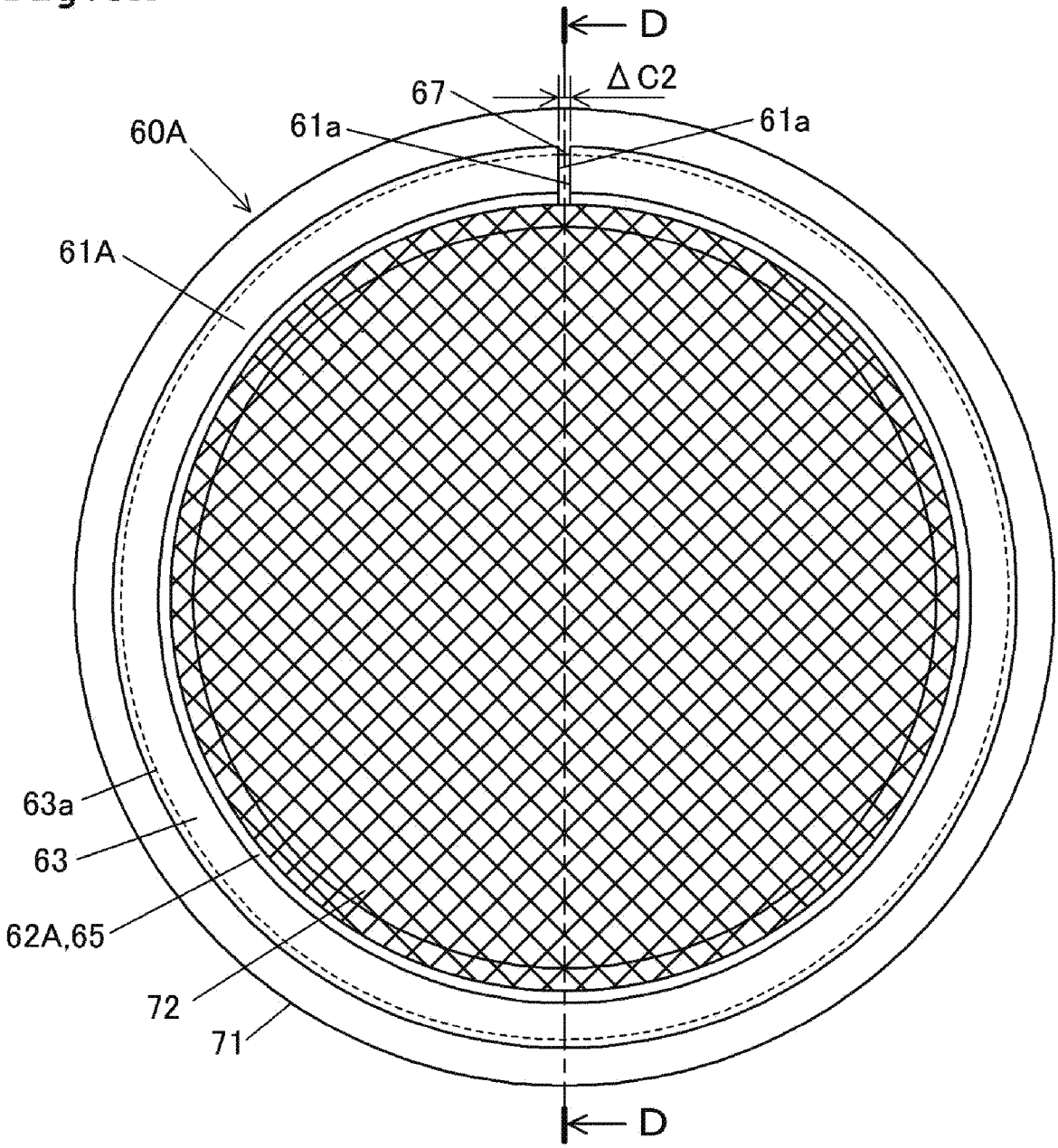
FIG. 5A is an upper view of a center ring 60A of a first variation from the side close to the attachment surface for the exhaust flange 510.
Figure 5B:
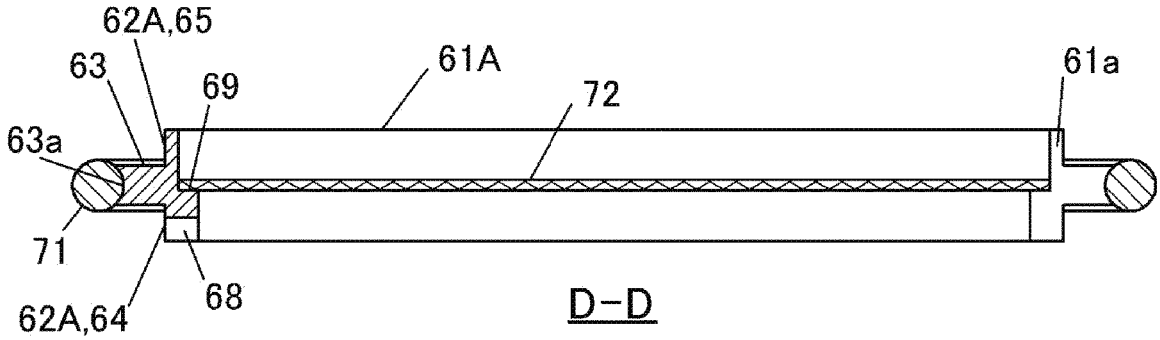
FIG. 5B is a sectional view along a D-D line of FIG. 5A.

FIG. 5A is an upper view of the center ring 60A of the first variation from the side close to the attachment surface for the exhaust flange 510, and FIG. 5B is a sectional view along a D-D line of FIG. 5A. The center ring 60A has the ring main body 61A, the O-ring 71, and the net 72.

The ring main body 61A is a member in such a C-shape that a cylinder is cut along the axial direction at the single cut portion 67 as described above. The ring main body 61A has a cylindrical portion 62A in a substantially cylindrical shape, and the flange portion 63. The cylindrical portion 62A is in a stepped cylindrical shape in which the inner diameter of a lower portion is smaller than that of an upper portion as viewed in FIG. 5B. In the above-described embodiment, the net 72 is sandwiched in the grooves 66 of the cylindrical portions 62. However, in the first variation, the net 72 is held with the outer peripheral edge of the net 72 being placed on an upper surface of a step portion 69. Note that the net 72 may be fixed with not-shown bolts.

The cutout portion 68 is provided at a single portion in the vicinity of the middle of the circumferential length of the pump-side cylindrical portion 64. The outer diameter d of the pump-side cylindrical portion 64 and the outer diameter of the chamber-side cylindrical portion 65 in the first variation are set as in the above-described embodiment.

In the center ring 60A of the first variation, the end surfaces 61*a* of the ring main body 61A in the circumferential direction face each other in the cut portion 67. The clearance distance between the opposing end surfaces 61*a* is represented by ΔC2. Since the single cut portion 67 is provided in the first variation, the clearance distance ΔC2 is substantially equal to the total (2×ΔC1) of the clearance distances ΔC1 of the two cut portions 67 in the above-described embodiment. The distance C1 is shorter than the ring main body diameter, and therefore, the clearance distance ΔC2 can be represented by Approximate Expression (5) described below:

$$\pi \times S\max \leq \Delta C2 \quad (5)$$

By the first variation, features and advantageous effects similar to those of the above-described embodiment are also provided.

Note that the cylindrical portion 62A may be in a stepped cylindrical shape in which the inner diameter of the upper portion is smaller than that of the lower portion as viewed in FIG. 5B.

By the first variation, the features and the advantageous effects similar to those of the above-described embodiment are also provided. Further, the number of components is less than that in the embodiment, leading to cost reduction.

(Second Variation)

In the above-described embodiment, the center ring 60 has the pair of ring main bodies 61 cut at the two cut portions 67. On the other hand, the center ring may have an O-shaped ring main body without the cut portion 67 as in a second variation. In the second variation, no cut portion 67 is provided, and therefore, the outer diameter d of the pump-side cylindrical portion 64 may be set as in the above-described embodiment within a range in which the value of the dimension difference D−d is a positive value. The outer diameter of the chamber-side cylindrical portion 65 is set as in the above-described embodiment. That is, clearance fit is employed.

By the second variation, features and advantageous effects similar to those of the above-described embodiment are also provided.

(Third Variation)

The dropping prevention structure in the embodiment and the first and second variations is the structure made such that the fitting dimension is defined and that the distance between the end surfaces of the ring main bodies is defined. However, the dropping prevention structure only by elastic force of the center ring may be made such that the distance C1 between the end surfaces and the movable distance of the ring main bodies are defined.

That is, the center ring dropping prevention structure can be defined as a structure made such that (1) ΔC1 and the fitting dimension are defined or (2) only ΔC1 is defined. In the case of (2), the maximum value for interference fit needs to be defined, and one example of the dropping prevention structure in the embodiment and the first to third variations can be defined as (1).

(Fourth Variation)

For the purpose of reliably preventing dropping of the center ring, protrusions may be, in a dropping prevention structure of a fourth variation, provided on the outer peripheral surfaces of the pump-side cylindrical portions 64 of the ring main bodies 61, and a vertical groove extending in the axial direction to house the protrusions and a horizontal groove as a protrusion stopper continuously extending from the vertical groove in the circumferential direction may be provided at the pump-side suction flange 20.

The center ring 60 is inserted into the suction flange 20 with the protrusions of the center ring 60 and the vertical groove of the suction flange 20 being aligned with each other. Thereafter, the center ring 60 is rotated such that the protrusions are housed in the horizontal groove. The protrusions are locked in the horizontal groove so that dropping of the center ring 60 can be prevented. Moreover, the attachment process can be easily performed.

Note that in this variation, design of the suction flange of the vacuum pump needs to be changed, but the center ring 60 in the above-described embodiment and the first and second variations has an advantage that the center ring 60 is applicable without modification of an existing vacuum pump.

The embodiment and the variations have been described above, but the present invention is not limited to these contents. Other aspects conceivable within the scope of the technical idea of the present invention are also included in the scope of the present invention.

Thus, the present invention is not limited to the turbomolecular pump, and is applicable to various vacuum pumps such as a vacuum pump including only a turbine blade vacuum pumping portion and a vacuum pump having only a screw groove vacuum pumping portion. The foreign particle entrance prevention member is not limited to the net-shaped member, and may be a member provided with numerous fine holes.

What is claimed is:

1. A center ring interposed between a vacuum chamber and a vacuum pump, comprising:

a ring main body including a first ring fitting portion to be fitted in a chamber-side fitting portion of the vacuum chamber and a second ring fitting portion to be fitted in a pump-side fitting portion of the vacuum pump;

a foreign particle entrance prevention member provided at the ring main body; and a dropping prevention structure configured to prevent the center ring from dropping from the pump-side fitting portion of the vacuum pump, wherein the ring main body is an annular member cut at one or more cut portions on a circumference, in the dropping prevention structure, end surfaces of the ring main bodies are arranged with a clearance in each cut portion, and the ring main body has a circumferential length shortened by a length corresponding to the clearance.

2. The center ring according to claim 1, wherein the ring main body includes a cutout portion configured to adjust rigidity upon bending in an inward radial direction.

3. The center ring according to claim 1, wherein the dropping prevention structure is provided only at the second ring fitting portion.

4. The center ring according to claim 1, wherein the dropping prevention structure is a structure in which a dimension difference between a diameter of the pump-side fitting portion of the vacuum pump and a diameter of the second ring fitting portion is set for any of interference fit or transition fit.

5. A vacuum pump comprising:

the center ring according to claim 1; and a pump main body including a suction flange as the pump-side fitting portion to be attached to the center ring.

6. The center ring according to claim 1, further comprising;

an elastic O-ring formed around an outermost circumference of the center ring.

7. The center ring according to claim 1, wherein the ring main body is a pair of annular members cut at two cut portions on the circumference, the clearance $\Delta C1$ is represented by Expression "$0.5\times\pi\times Smax\leq\Delta C1$" based on the maximum value Smax of the interference.

8. The center ring according to claim 1, wherein the ring main body is a single annular member cut at one cut portions on the circumference, the clearance $\Delta C2$ is represented by Expression "$\pi\times Smax\leq\Delta C2$" based on the maximum value Smax of the interference.

* * * * *